US009296209B2

(12) United States Patent
Park et al.

(10) Patent No.: US 9,296,209 B2
(45) Date of Patent: Mar. 29, 2016

(54) IMAGE FORMING APPARATUS

(71) Applicants: Soyoung Park, Kanagawa (JP); Yoichi Ito, Tokyo (JP); Mikio Ohashi, Kanagawa (JP); Yoshinori Uchino, Kanagawa (JP); Noriyuki Sai, Kanagawa (JP)

(72) Inventors: Soyoung Park, Kanagawa (JP); Yoichi Ito, Tokyo (JP); Mikio Ohashi, Kanagawa (JP); Yoshinori Uchino, Kanagawa (JP); Noriyuki Sai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/570,006

(22) Filed: Dec. 15, 2014

(65) Prior Publication Data

US 2015/0183221 A1 Jul. 2, 2015

(30) Foreign Application Priority Data

Dec. 28, 2013 (JP) ..... 2013-273646

(51) Int. Cl.
*B41J 2/165* (2006.01)
*B41J 3/407* (2006.01)
*B41J 29/17* (2006.01)

(52) U.S. Cl.
CPC ..... *B41J 2/16526* (2013.01); *B41J 3/4073* (2013.01); *B41J 29/17* (2013.01)

(58) Field of Classification Search
CPC ..... B41J 2002/1742; B41J 2/16523; B41J 2/175; B41J 2002/1728; B41J 2/16535; B41J 2/16547
USPC ..... 347/22, 29, 30, 33, 35, 36
See application file for complete search history.

(56) References Cited

U.S. PATENT DOCUMENTS

| | | | | |
|---|---|---|---|---|
| 2012/0056932 | A1 | 3/2012 | Matsubara et al. | |
| 2012/0056933 | A1 | 3/2012 | Tanaka et al. | |
| 2012/0133706 | A1 | 5/2012 | Park | |
| 2012/0133707 | A1 | 5/2012 | Kikkawa et al. | |
| 2012/0224001 | A1 | 9/2012 | Park | |
| 2012/0320125 | A1 | 12/2012 | Katoh et al. | |
| 2013/0120508 | A1 * | 5/2013 | Jo | 347/85 |
| 2013/0182036 | A1 | 7/2013 | Park | |
| 2014/0071200 | A1 | 3/2014 | Park | |
| 2014/0152745 | A1 | 6/2014 | Park et al. | |
| 2014/0204413 | A1 | 7/2014 | Park et al. | |
| 2014/0253655 | A1 | 9/2014 | Sai et al. | |

FOREIGN PATENT DOCUMENTS

| | | |
|---|---|---|
| JP | 2010-000780 | 1/2010 |
| JP | 2010-247036 | 11/2010 |

* cited by examiner

*Primary Examiner* — Jannelle M Lebron
(74) *Attorney, Agent, or Firm* — Cooper & Dunham LLP

(57) ABSTRACT

An image forming apparatus includes a recording head, a receiving face member, and a cleaner. The recording head discharges droplets. The receiving face member includes a receiving face to receive dummy discharge droplets discharged from the recording head and not contributing to image formation. With rotation of the receiving face member, the receiving face movable between a facing position at which the receiving face faces the recording head and a retracted position at which the receiving face does not face the recording head. The cleaner cleans the receiving face of the receiving face member.

12 Claims, 14 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application No. 2013-273646, filed on Dec. 28, 2013, in the Japan Patent Office, the entire disclosure of which is hereby incorporated by reference herein.

BACKGROUND

1. Technical Field

Embodiments of the present disclosure relate to an image forming apparatus, and particularly to an image forming apparatus including a head to discharge droplets.

2. Description of the Related Art

Image forming apparatuses are used as printers, facsimile machines, copiers, plotters, or multifunction peripherals having, e.g., two or more of the foregoing capabilities. For example, an inkjet recording apparatus is known as an image forming apparatus of a liquid-discharge recording system using a recording head. The recording head includes a liquid discharge head (droplet discharge head) that discharges droplets.

In such an image forming apparatus, dummy discharge (also referred to as preliminary discharge, flushing, and the like) is performed to prevent clogging of nozzles and the like. The dummy discharge is to discharge droplets (dummy discharge droplets), which do not contribute to image forming, at predetermined timing.

For example, an image forming apparatus includes an ink receiver with an opening under nozzles of a recording head, and a shutter device that is mechanically opened and closed in the opening of the ink receiver. After moving the recording head to a print start position, the apparatus repeats the preliminary discharge with the shutter closed, and then opens the shutter to start printing after a discharge amount is stabilized.

SUMMARY

In at least one embodiment of this disclosure, there is provided an image forming apparatus including a recording head, a receiving face member, and a cleaner. The recording head discharges droplets. The receiving face member includes a receiving face to receive dummy discharge droplets discharged from the recording head and not contributing to image formation. With rotation of the receiving face member, the receiving face movable between a facing position at which the receiving face faces the recording head and a retracted position at which the receiving face does not face the recording head. The cleaner cleans the receiving face of the receiving face member.

In at least one embodiment of this disclosure, there is provided an image forming apparatus including a recording head, a conveyance unit, a receiving face member, and a cleaner. The recording head discharges droplets. The conveyance unit conveys a print medium facing the recording head. The receiving face member includes a receiving face to receive dummy discharge droplets discharged from the recording head and not contributing to image formation. With rotation of the receiving face member, the receiving face is movable between a facing position at which the receiving face lies between the conveyance unit and the recording head and faces the recording head and a retracted position at which the receiving face is retracted from between the conveyance unit and the recording head and does not face the recording head. The cleaner cleans the receiving face of the receiving face member.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
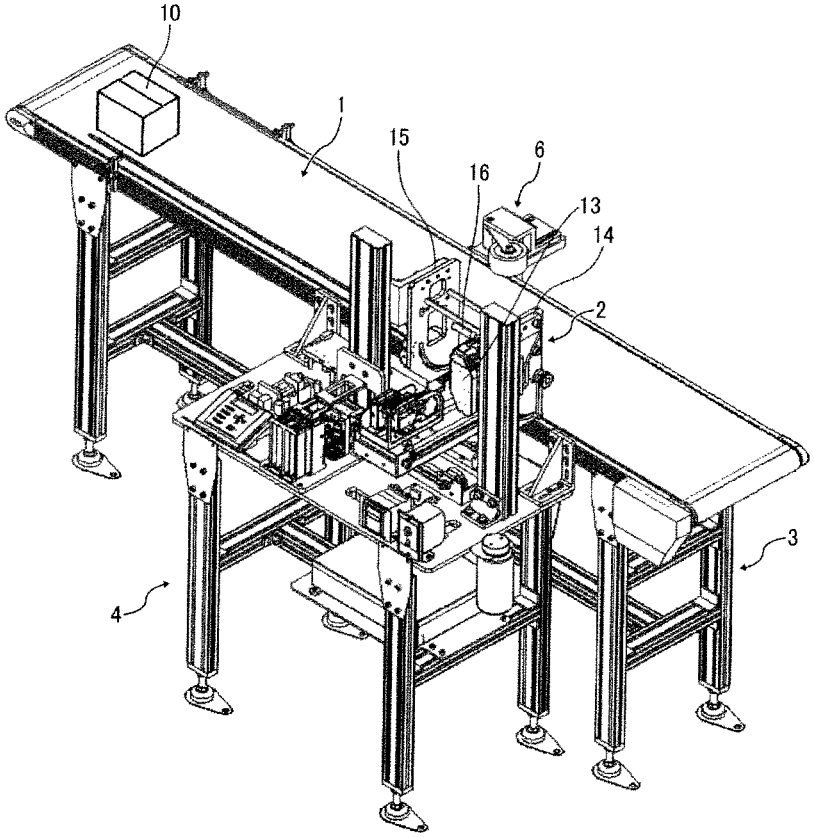
FIG. 1 is an overall perspective view of an example of an image forming apparatus according to at least one embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image formation" is used as a synonym for "recording" or "printing". The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Although the embodiments are described with technical limitations with reference to the attached drawings, such description is not intended to limit the scope of the disclosure and all of the components or elements described in the embodiments of this disclosure are not necessarily indispensable.

Figure 2:
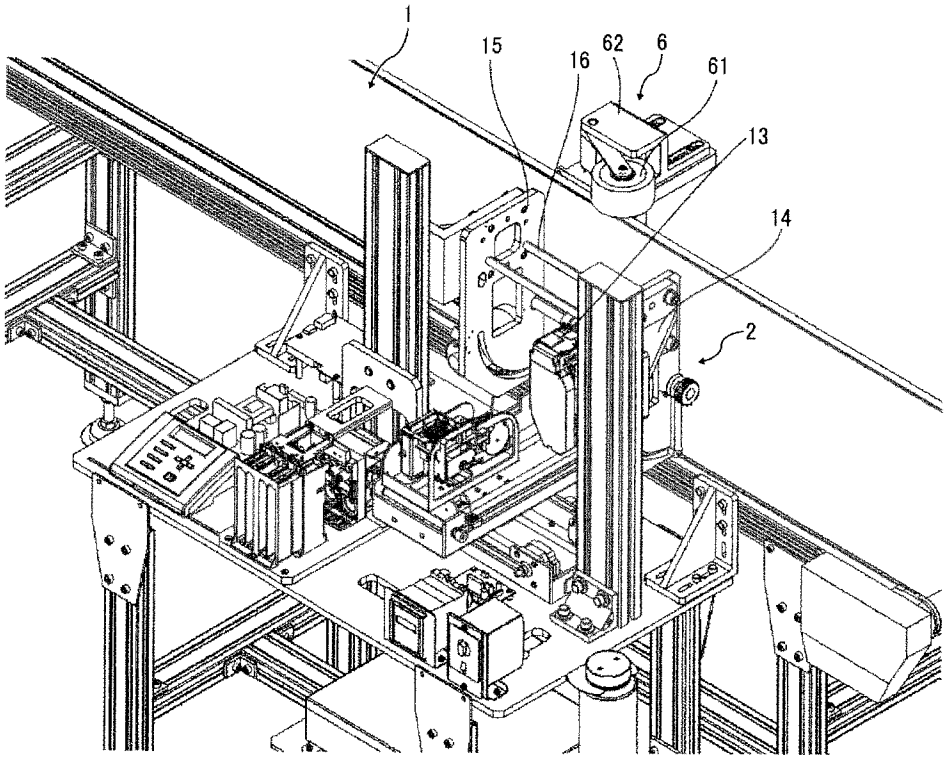
FIG. 2 is an enlarged perspective view of an image forming unit according to at least one embodiment of the present disclosure.
Figure 3:
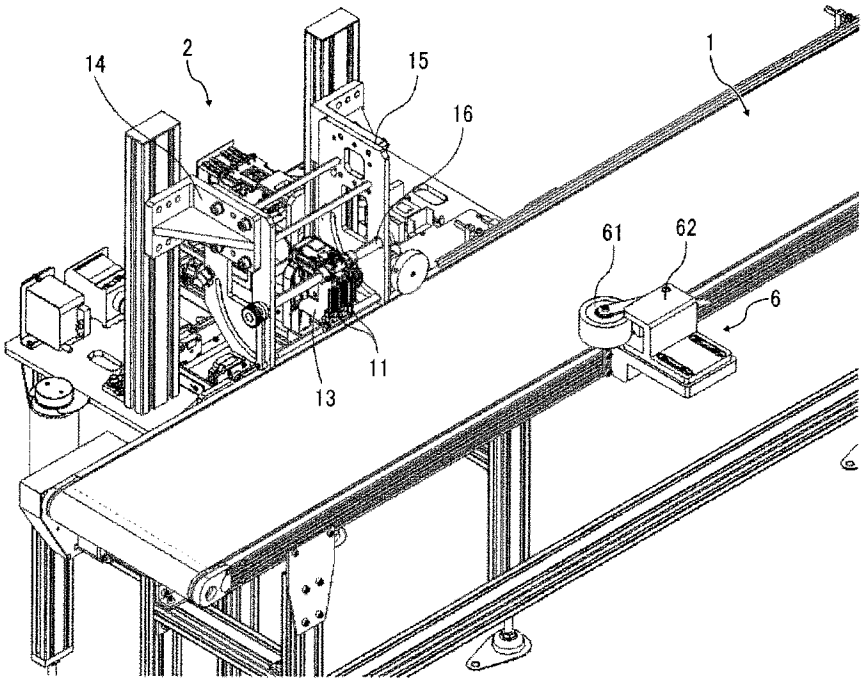
FIG. 3 is a perspective view of the image forming unit as viewed from the opposite side of FIG. 2.

Hereinafter, embodiments of the present disclosure will be described with reference to the attached drawings. First, an image forming apparatus according to at least one embodiment of this disclosure is described with reference to FIGS. 1 to 3. FIG. 1 is an overall perspective view of an image forming apparatus according to at least one embodiment of this disclosure. FIG. 2 is an enlarged perspective view of an image forming unit according to at least one embodiment of this disclosure. FIG. 3 is a perspective view of the The image forming unit as viewed from the opposite side of FIG. 2. The image forming apparatus is an apparatus that forms an image on an outer surface of, for example, a corrugated fiberboard box (for example, the apparatus is referred to as corrugated fiberboard printer). The image forming apparatus includes a belt conveyor 1 and an image forming unit 2. The belt conveyor 1 is a conveyance unit that conveys a corrugated fiberboard box 10 that is a print medium. The image forming unit 2 forms an image on a surface of the corrugated fiberboard box 10 conveyed by the belt conveyor 1. It is to be noted that, hereinafter, description will be given using the conjugated fiberboard box 10 as the print medium. However, the embodiment is not limited thereto.

The belt conveyor 1 is arranged on a frame 3, and the image forming unit arranged on a frame 4.

The image forming unit 2 includes a carriage 13 in which two recording heads 11 are mounted. The recording head 11 is formed of a liquid discharge head that discharges droplets. The carriage 13 is held by a guide member 16, which bridges side plates 14 and 15, in a scannable manner (movable manner).

In FIG. 3, to form an image on a side surface of the corrugated fiberboard box 10 from the recording head 11, the recording head 11 is held in an attitude to discharge droplets in a horizontal direction.

Furthermore, a pressing unit 6 is arranged at the opposite side of the image forming unit 2 across the belt conveyor 1. The pressing unit 6 presses the corrugated fiberboard box 10 onto a gap regulation member on the side of the recording head 11 immediately before printing. The pressing unit 6 includes a roller 61 that can come into contact with the outer surface of the corrugated fiberboard box 10, and a holder 62 that energizes and holds the roller 61 toward the recording head 11 in a rotatable manner. With this configuration, a gap between a nozzle face and the side surface of the corrugated fiberboard box 10 is kept constant at the time of printing, thus allowing stable image formation.

In the image forming apparatus with the above configuration, the recording head 11 of the image forming unit 2 discharges the droplets while the corrugated fiberboard box 10 is conveyed by the belt conveyor 1, and a desired image is formed on the side surface of the corrugated fiberboard box 10.

Figure 4:
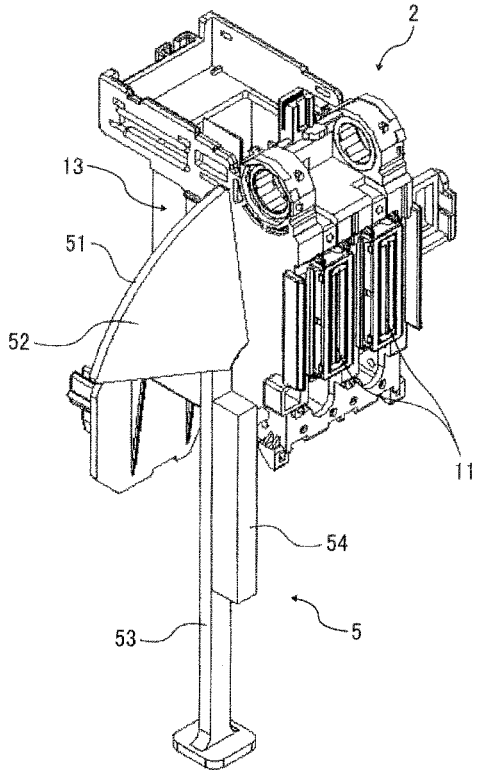
FIG. 4 is a perspective view of an image forming unit and its vicinity with a receiving face placed at a retracted position in a first embodiment of the present disclosure.
Figure 5:
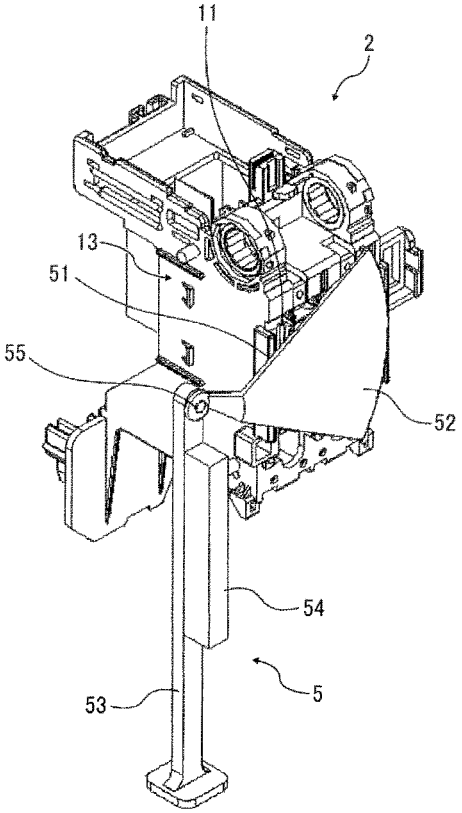
FIG. 5 is a perspective view of the image forming unit and its vicinity with the receiving face placed at the retracted position in the first embodiment.
Figure 6:
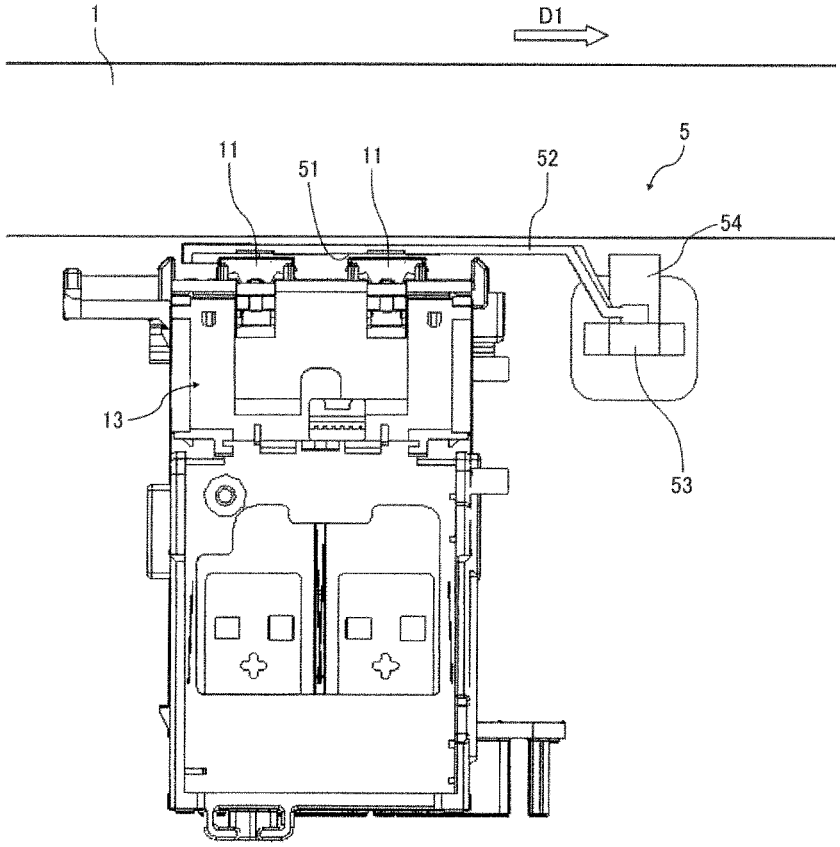
FIG. 6 is a plan view of the image forming unit and its vicinity in the first embodiment.

Next, a first embodiment of the present disclosure will be described with reference to FIGS. 4 to 6. FIG. 4 is a perspective view of an image forming unit and its vicinity when a receiving face is at a retracted position in the first embodiment. FIG. 5 is a perspective view of the image forming unit and its vicinity when the receiving face is at the retracted position in the first embodiment. FIG. 6 is a plan view of the image forming unit and its vicinity in the first embodiment.

A dummy discharge receiver 5 is placed between the image forming unit 2 and the belt conveyor 1. The dummy discharge receiver 5 receives dummy discharge droplets from the recording head 11.

The dummy discharge receiver 5 includes a fan-shaped receiving face member 52. The receiving face member 52 lies between the recording head 11 of the image forming unit 2 and the belt conveyor 1 that is a conveyance unit to convey a corrugated fiberboard box 10 in a direction indicated by arrow D1 in FIG. 6, and can face the recording head 11. A receiving face 51 that receives the dummy discharge droplets discharged from the recording head 11 is formed on the receiving face member 52. It is to be noted that the shape of the receiving face member 52 is not limited to the fan shape.

The receiving face member 52 is rotatably supported with a shaft 55 that is arranged at an upper end of a receiving face support 53. The axis of the shaft 55 is parallel to a droplet discharge direction. Accordingly, by rotation of the receiving face member 52, the receiving face 51 can move between a facing position where the receiving face 51 faces the recording head 11, and the retracted position where the receiving face 51 does not face the recording head 11.

Furthermore, a cleaner 54 is provided on the receiving face support 53. The cleaner 54 comes into contact with the receiving face 51 when the receiving face member 52 is rotated, and cleans the receiving face 51.

Here, the thickness of the receiving face member 52 is preferably thin so that a gap between the conveyed corrugated fiberboard box 10 and the nozzle face of the recording head 11 is made small.

Meanwhile, the receiving face member 52 preferably has a thickness to the extent not to bend toward a conveyance side of the corrugated fiberboard box 10 (a side opposite to a side where the receiving face member 52 comes into contact with the cleaner 54) when the cleaner 54 cleans the receiving face (ink adherence face) 51. That is, if the receiving face member 52 bends when the cleaner 54 cleans the receiving face 51, quality of the cleaning is degraded. Furthermore, if the receiving face member 52 bends, the receiving face member 52 presses the corrugated fiberboard box 10 next to be printed, which is arranged on the belt conveyor (conveyance passage) 1. In this case, degradation in printing quality is more likely to occur due to widening of the gap between the nozzles of the recording head 11 and the corrugated fiberboard box 10. Therefore, the receiving face member 52 has the thickness to the extent not to cause the bending at the time of cleaning.

Furthermore, preferably, the receiving face support 53 and the cleaner 54 do not more protrude toward the conveyance side of the corrugated fiberboard box 10 than the receiving face 51 in the droplet discharge direction. This is because collision or interference with the conveyed corrugated fiberboard box 10 should be avoided.

The quality of the material of the cleaner 54 is like an absorber. The cleaner 54 can also clean the receiving face 51 by absorbing a waste liquid of the ink adhering to the receiving face 51. The cleaner 54 can also clean the receiving face 51 by scraping the ink on the receiving face 51 such that a rubber material wipes the ink. It is to be noted that, when employing the wiping method, a portion that stores the scraped waste liquid of the ink is necessary.

Furthermore, when using the cleaner 54 like an absorber, the cleaner 54 can be formed into a roller shape. In this case, when the receiving face 51 comes into contact with the cleaner 54 while being rotated, the cleaner 54 is also rotated, thereby absorbing the waste liquid of the ink on the entire peripheral surface. Therefore, adherence of a large amount of ink to a small portion can be prevented, and the frequency of replacement of the absorber can be decreased.

Furthermore, in the present embodiment, the cleaner 54 is supported by the receiving face support 53. However, the cleaner 54 can be arranged in the vicinity of the receiving face support 53. As for a supporting structure in which the cleaner 54 is supported by the receiving face support 53, the cleaner 54 may be fixed to the receiving face support 53 with a claw or the like (note that a portion that comes into contact with the receiving face 51 should not be in contact with the claw member). Alternatively, the cleaner 54 may be glued and fixed. Furthermore, preferably, the cleaner 54 is replaceable.

It is to be noted that, in the present embodiment, a configuration in which the recording head 11 is vertically arranged (a configuration in which the droplets are discharged in the horizontal direction) has been described. However, a configuration in which the recording head 11 is horizontally arranged (a configuration in which the droplets are discharged downward in the vertical direction) can be employed. It is to be noted that the cleaner 54 is preferably an absorber when the recording head 11 is horizontally arranged. If cleaning is conducted by wiping with the cleaner 54 as a rubber material, the wiped waste liquid of the ink may splash and adhere onto the belt conveyor 1 for conveyance, and contaminate the surface of the corrugated fiberboard box.

Figure 7A:
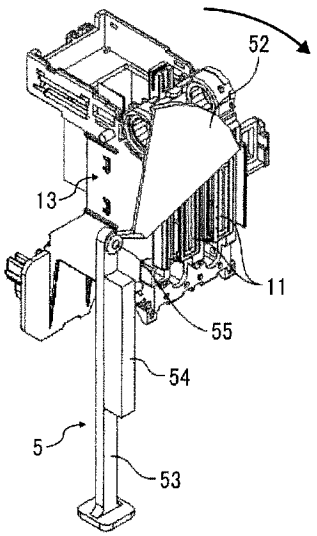
FIGS. 7A to 7C are perspective views of the image forming unit and its vicinity for illustration of driving of the receiving face, dummy discharge timing, and cleaning of the receiving face in the first embodiment.
Figure 7B:
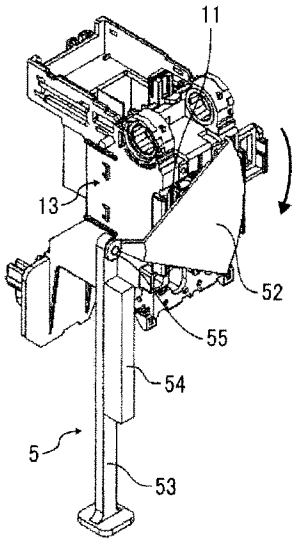
Figure 7C:
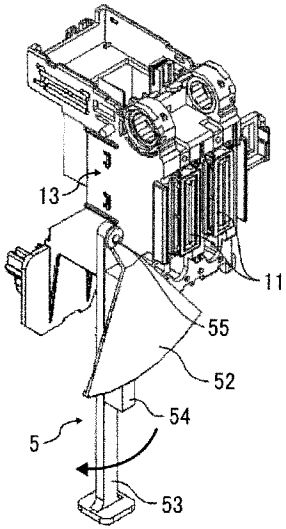

Next, driving of the receiving face, dummy discharge timing, and cleaning of the receiving face in the present embodiment will be described with reference to FIGS. 7A to 7C. FIGS. 7A to 7C are perspective views similar to FIG. 4 provided for description.

The receiving face member 52 is rotatable by a motor. As illustrated in FIGS. 7A and 7B, when the receiving face member 52 is rotated, and the receiving face 51 is moved to the facing position where the receiving face 51 faces the nozzles of the recording head 11, a dummy discharge operation is performed. The dummy discharge operation is to discharge, from the recording head 11, droplets (dummy discharge droplets) that do not contribute to the image formation.

More specifically, detectors (sensors) that detect presence of the receiving face 51 are provided above and below a nozzle array of the recording head 11. Then, the dummy discharge is performed through all of the nozzles when both of the upper and lower sensors are detecting the receiving face 51, that is, in a state where the receiving face 51 has moved to the facing position where the receiving face 51 faces and covers all of the nozzles of the recording head 11, as illustrated in FIG. 7B.

Alternatively, a rotation angle of the receiving face 51 is detected and controlled, and when the receiving face 51 is moved to the position where the receiving face 51 faces all of the nozzles, the dummy discharge can be performed through all of the nozzles.

Alternatively, the dummy discharge can be performed with the nozzles arranged at a position facing the receiving face 51. With this method, the nozzles are partially selected, and the dummy discharge is performed. Therefore, the size of the receiving face 51 can be small (a size to cover all of the nozzles is not necessary).

The dummy discharge operation with respect to the receiving face 51 is completed, as described above, the receiving face member 52 is rotated to the position of the cleaner 54, as illustrated in FIG. 7C, and the waste liquid of the ink adhering to the receiving face 51 is removed and cleaned by the cleaner 54.

Here, a temperature/humidity sensor that detects ambient temperature/ambient humidity is provided, and a rotation speed of the receiving face 51 after the dummy discharge can be changed according to the detected temperature/humidity. It is to be noted that the temperature/humidity sensor can be preferably arranged near the carriage 13.

That is, under a condition where a dummy discharge amount is large, such as under a low temperature/low humidity environment, the rotation speed of the receiving face 51 after the dummy discharge is set fast. Accordingly, the receiving face 51 can be rotated before the dummy-discharged ink is dropped from the receiving face 51, thus protecting the inside of the apparatus from ink contamination.

Furthermore, the number of times of cleaning the receiving face 51 by the cleaner 54 after the dummy discharge can be changed according to the detected temperature/humidity, That is, under the condition where the dummy discharge amount is large, such as under the low temperature/low humidity environment, the number of times of cleaning the receiving face 51 by the cleaner 54 after the dummy discharge is increased, thus enhancing cleaning performance of the waste liquid adhering to the receiving face 51.

When the number of times of cleaning is increased, a time required for the dummy discharge operation is increased. Therefore, a configuration to decrease the conveyance speed of a print medium can be employed. Accordingly, reliable dummy discharge can be performed, thus preventing degradation in the image quality.

Figure 8:
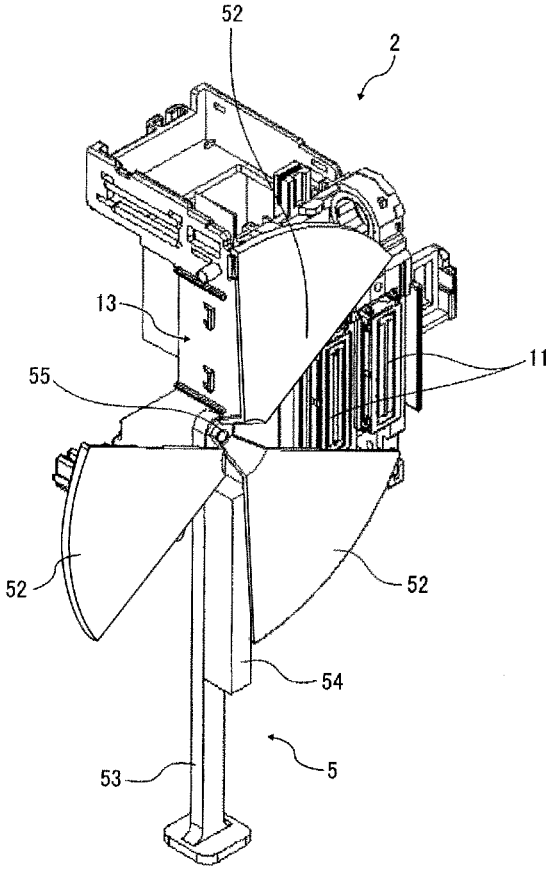
FIG. 8 is a perspective view of an image forming unit and its vicinity in a second embodiment of the present disclosure.

Next, a second embodiment of the present disclosure will be described with reference to FIG. 8. FIG. 8 is a perspective view of an image forming unit and its vicinity in the second embodiment.

In the present embodiment, a plurality of receiving face members 52 each having a receiving face 51 is provided (here, three receiving face members 52 are provided; however, two, or four or more receiving face members 52 may be provided).

In this case, a gap between two receiving face members 52 typically needs to be the length of a nozzle array or more.

Furthermore, the receiving face members 52 preferably have a configuration in which each of the receiving face members 52 is individually replaceable. When adherence of the waste liquid of the ink becomes firmer over time, the receiving face member 52 is replaced, thus preventing non-discharge of ink from nozzles due to transfer of the adhering material to the nozzle face, or transfer of dust to the print medium (corrugated fiberboard box).

Here, a configuration can be employed in which the temperature/humidity sensor that detects the ambient temperature/ambient humidity is provided, and the dummy discharge is separately performed with respect to the plurality of receiving faces 51 according to the detected temperature/humidity.

That is, under the condition where the dummy discharge amount is large, such as under the low temperature/low humidity environment, the dummy discharge is separately performed with respect to the plurality of receiving faces 51. Such a configuration more effectively prevents the ink drop from the receiving faces 51, as compared with a case where dummy-discharged ink is received by a single receiving face 51.

As described above, when the dummy discharge is separately performed with respect to the plurality of receiving faces 51, a time required for the dummy discharge operation is increased. Therefore, the configuration to decrease the conveyance speed of the print medium can be employed. Accordingly, reliable dummy discharge can be performed, thus preventing degradation in the image quality.

Figure 9:
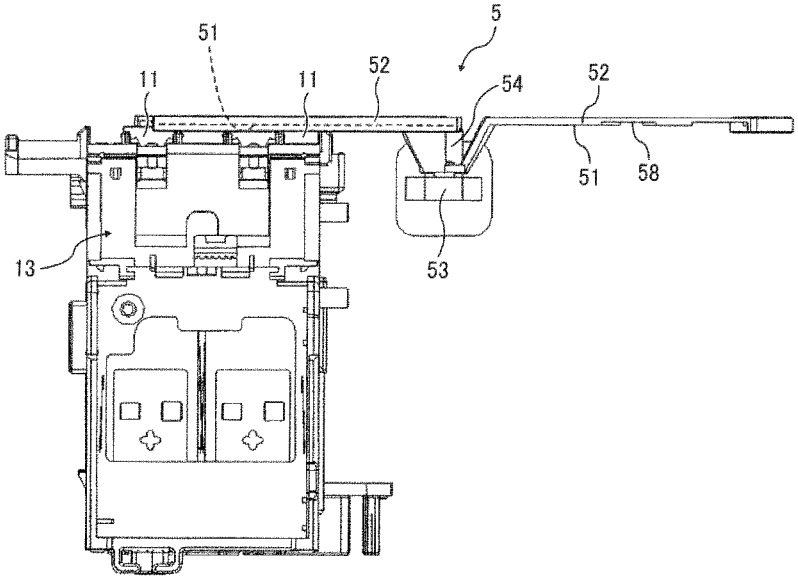
FIG. 9 is a plan view of an image forming unit and its vicinity in a third embodiment of the present disclosure.
Figure 10:
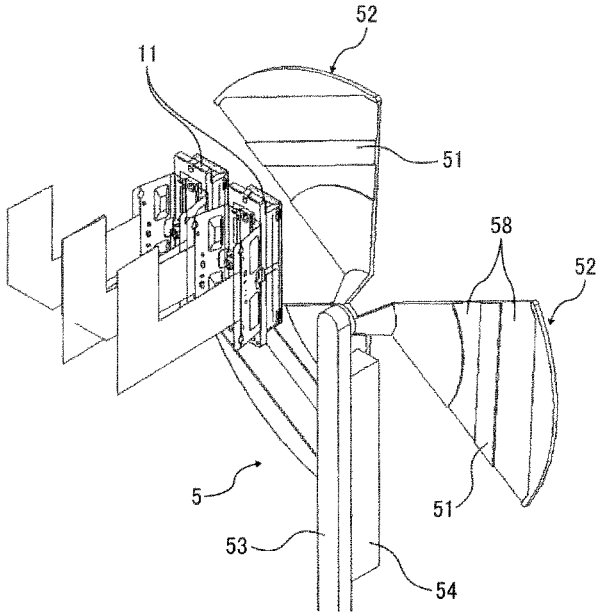
FIG. 10 is a perspective view of a receiving face member as viewed from a recording head side in a first example of the third embodiment.
Figure 11:
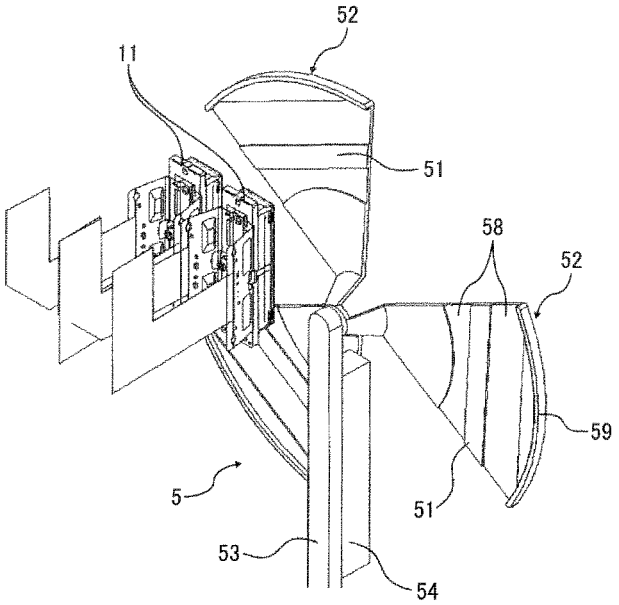
FIG. 11 is a perspective view of a receiving face member as viewed from a recording head side in a second example of the third embodiment.

Next, different examples of a third embodiment of the present disclosure will be described with reference to FIGS. 9 to 11. FIG. 9 is a plan view of an image forming unit and its vicinity in the third embodiment. FIG. 10 is a perspective view of a receiving face member as viewed from a recording head side, illustrating a first example. FIG. 11 is a perspective view of a receiving face member as viewed from a recording head side, illustrating a second example.

In the present embodiment, a storage 58 that stores an adhering waste liquid is provided on the side of a receiving face 51 of a receiving face member 52.

With this configuration, when the receiving face 51 is rotated, the waste liquid can be prevented from splashing outward of the receiving face 51 by centrifugal force. Such a configuration prevents the contamination in an apparatus or a head/nozzle face.

Here, the storage 58 can be provided in the receiving face 51 in a recessed manner, as illustrated in FIGS. 10 and 11.

Furthermore, in the second example illustrated in FIG. 11, an L-shaped rib 59 is provided on a peripheral edge of the receiving face 51 together with the storage 58, so that scatter to the periphery is more reliably suppressed.

It is to be noted that a cleaner in the present embodiment is preferably a member in a liquid absorption method with an absorber, rather than in a wiping method with a rubber material. The absorber is preferably formed into a shape that can absorb a liquid at a bottom of the storage 58 of the receiving face 51.

Figure 12:
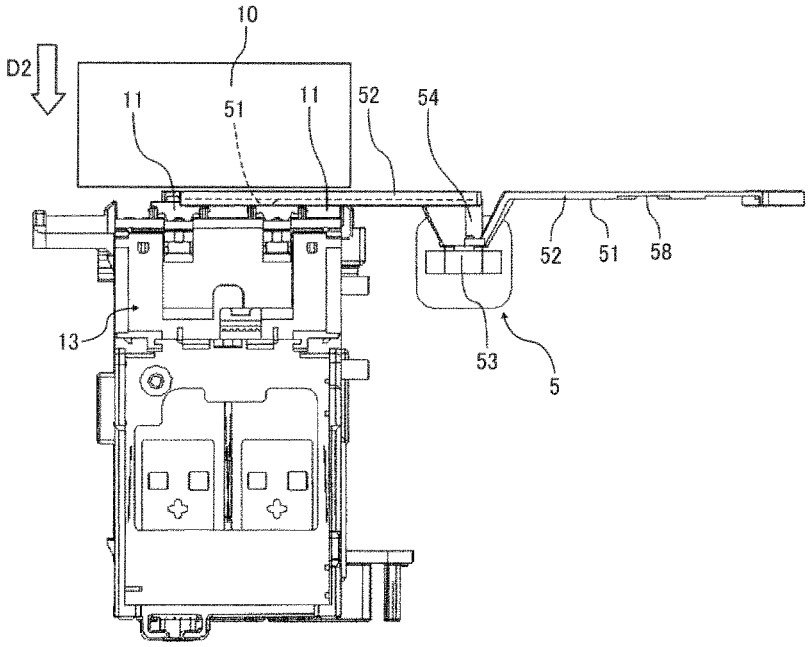
FIG. 12 is a plan view of an image forming unit and its vicinity in a fourth embodiment of the present disclosure.

Next, a fourth embodiment of the present disclosure will be described with reference to FIG. 12. FIG. 12 is a plan view of an image forming unit and its vicinity in the fourth embodiment.

In the present embodiment, a receiving face member 52 also functions as a gap regulator that regulates a gap between a nozzle face (droplet discharge face) and a print medium (corrugated fiberboard box 10).

As described above, in the image forming apparatus that prints an image on the corrugated fiberboard box 10, the corrugated fiberboard box 10 is conveyed while being pressed (in a direction indicated by arrow D2 in FIG. 12) onto a gap regulation member on the side of a recording head 11 by a pressing unit 6 immediately before printing.

Here, the gap regulation member can be provided in a carriage 13, or also can be provided on the side of a belt conveyor 1. However, the receiving face member 52 has the function of the gap regulation member, thus allowing a reduction in the number of components. It is to be noted that the receiving face member 52 of this case needs strength to the extent not to bend against pressing force of the corrugated fiberboard box 10.

Figure 13:
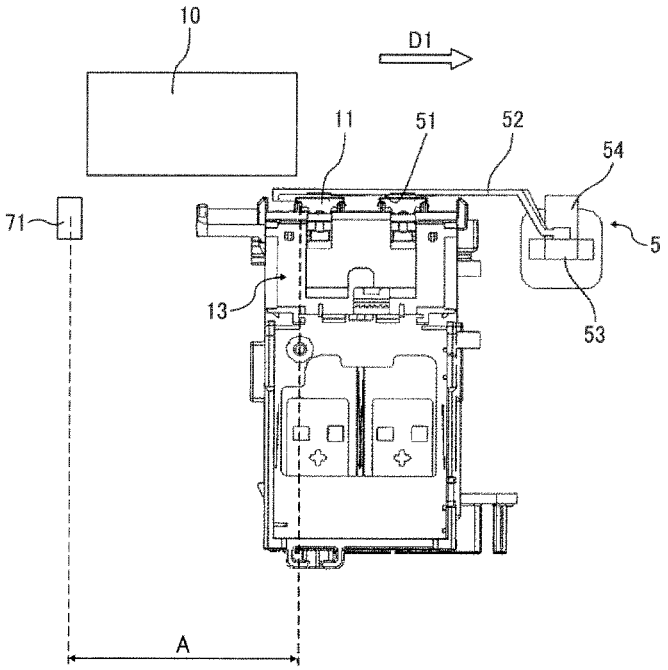
FIG. 13 is a plan view of an image forming unit and its vicinity in a fifth embodiment of the present disclosure.

Next, a fifth embodiment of the present disclosure will be described with reference to FIG. 13. FIG. 13 is a plan view of an image forming unit and its vicinity in the fifth embodiment.

In the present embodiment, a media sensor 71 is provided at an upper stream of an image forming unit 2 in a media conveyance direction indicated by arrow D1 in FIG. 13. The media sensor 71 is a medium detector that detects presence of a print medium (corrugated fiberboard box 10).

Here, the following relationship is established between a distance A from the media sensor 71 to a recording head 11 that is at an uppermost stream in the media conveyance direction D1, and a time $\alpha$ that is required for a dummy discharge operation.

$$A \geq (\alpha \times \text{maximum conveyance drive speed})$$

Immediately after the print medium (corrugated fiberboard box 10) is detected at the upper stream in the conveyance direction D1, dummy discharge (dummy discharge before printing) is conducted before start of printing.

Accordingly, stability of nozzles can be secured. Therefore, degradation in image quality can be prevented.

Figure 14:
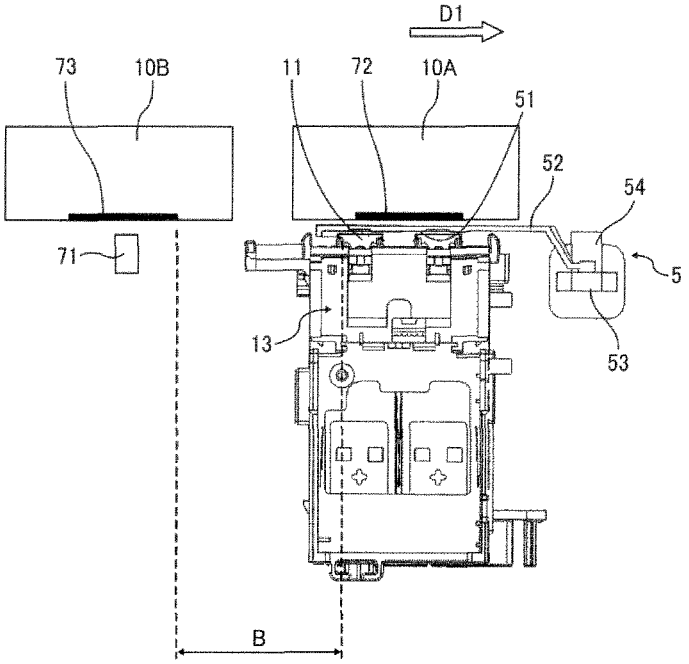
FIG. 14 is a plan view of an image forming unit and its vicinity in a sixth embodiment of the present disclosure.

Next, a sixth embodiment of the present disclosure will be described with reference to FIG. 14. FIG. 14 is a plan view of an image forming unit and its vicinity in the sixth embodiment.

Also in the present embodiment, a media sensor 71 is provided at an upper stream of an image forming unit 2 in a media conveyance direction indicated by arrow D1 in FIG. 14. The media sensor 71 is a medium detector that detects presence of a print medium.

Here, the media sensor 71 detects a distance B from a print end position of a preceding print medium 10A to a print start position of a continuous subsequent print medium 10B. When a time $\alpha$ required for a dummy discharge operation is longer than a time required for the subsequent print medium 10B to move across the distance B, a conveyance speed of the subsequent recording medium 10B with the belt conveyor 1 is controlled to decrease. It is to be noted that the distance B is a distance from the print end position of a print area 72 of the preceding print medium 10A to the print start position of an expected print area 73 of the subsequent print medium 10B.

As a result, the dummy discharge operation can be reliably performed between the continuously conveyed print media, and stability of nozzles can be secured. Such a configuration prevents degradation in image quality of the next conveyed print medium.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head to discharge droplets;

a conveyance unit to convey a print medium facing the recording head;

a receiving face member including a receiving face to receive dummy discharge droplets discharged from the recording head and not contributing to image formation, the receiving face movable, with rotation of the receiving face member, between a facing position at which the receiving face lies between the conveyance unit and the recording head and faces the recording head and a retracted position at which the receiving face is retracted from between the conveyance unit and the recording head and does not face the recording head; and a cleaner to clean the receiving face of the receiving face member.

2. The image forming apparatus according to claim 1, wherein a rotation speed of the receiving face member is adjustable according to at least one of ambient temperature and ambient humidity.

3. The image forming apparatus according to claim 1, wherein number of time of cleaning the receiving face of the receiving face member by the cleaner is adjustable according to at least one of ambient temperature and ambient humidity.

4. The image forming apparatus according to claim 1, wherein a conveyance speed of the print medium by the conveyance unit is adjustable according to at least one of ambient temperature and ambient humidity.

5. The image forming apparatus according to claim 4, wherein the conveyance unit reduces the conveyance speed when a time required for which a subsequent print medium following a preceding print medium on which printing has been finished reaches a print start position is shorter than a time required for discharge of the dummy discharge droplets.

6. The image forming apparatus according to claim 1, wherein the cleaner cleans the receiving face when the receiving face rotates and moves to the retracted position.

7. The image forming apparatus according to claim 1, further comprising:

a support member to support the receiving face member and including a rotation shaft, the receiving face being movable, with rotation of the receiving face member about the rotation shaft, between the facing position at which the receiving face faces the recording head and the retracted position at which the receiving face does not face the recording head.

8. The image forming apparatus according to claim 7, wherein the shaft has an axis parallel to a droplet discharge direction of the recording head, and the cleaner is disposed on the support.

9. The image forming apparatus according to claim 7, wherein number of the receiving face member is two or more.

10. The image forming apparatus according to claim 7, wherein the receiving face member includes a storage to store a waste liquid adhering to the receiving face.

11. The image forming apparatus according to claim 7, wherein the cleaner cleans the receiving face when the receiving face rotates and moves to the retracted position.

12. An image forming apparatus comprising:

a recording head to discharge droplets;

a receiving face member including a receiving face to receive dummy discharge droplets discharged from the recording head and not contributing to image formation, the receiving face movable, with rotation of the receiving face member, between a facing position at which the receiving face faces the recording head and a retracted position at which the receiving face does not face the recording head; and a cleaner to clean the receiving face of the receiving face member, wherein the receiving face member is also a gap regulator to regulate a gap between a droplet discharge face of the recording head and a print medium.

* * * * *